United States Patent [19]

Badali

[11] 4,406,080

[45] Sep. 27, 1983

[54] ANTI-TWIST FOREARM MOUNTING SYSTEM

[75] Inventor: Joseph A. Badali, Ogden, Utah

[73] Assignee: Browning Arms Company, Morgan, Utah

[21] Appl. No.: 284,734

[22] Filed: Jul. 20, 1981

[51] Int. Cl.[3] ..... F41C 25/08

[52] U.S. Cl. ..... 42/75 A; 42/17

[58] Field of Search ..... 42/75 A, 17, 49, 71 R, 42/75 B

[56] References Cited

U.S. PATENT DOCUMENTS 1,370,836 3/1921 Nelson ..... 42/75 A 1,565,384 12/1925 Nelson ..... 42/75 B

OTHER PUBLICATIONS

*Firearms Assembly Handbook,* National Rifle Association, Washington, D.C., 1960, p. 150.

*Primary Examiner*—Charles T. Jordan

*Assistant Examiner*—Ted L. Parr

*Attorney, Agent, or Firm*—Trask & Britt

[57] ABSTRACT

The forearm of a pump shotgun is mounted for reciprocal movement with respect to the magazine tube through a coupling system which prevents twisting of the forearm. A coupling system includes grooves in the exterior sidewall of the magazine tube and detents on the exterior sidewall of the forearm mount tube in registration with the grooves.

10 Claims, 3 Drawing Figures

ANTI-TWIST FOREARM MOUNTING SYSTEM

BACKGROUND OF THE INVENTION

1. Field

This invention pertains to pump shotguns, and is specifically directed to an improved means for mounting the forearm with respect to the magazine tubes of such shotguns.

2. State of the Art

Many styles and types of pump shotguns are in use. Although a variety of mechanisms have evolved, in general all pump shotguns include a tubular magazine in which shotgun shells are stored below the barrel of the gun and forward of the receiver. The mechanism for sequentially removing shells from storage and loading them into the chamber is actuated by reciprocal motion of a forearm mounted to slide axially with respect to a magazine tube. Commonly, the forearm carries a forearm mount tube which fits concentrically around the magazine tube to facilitate smooth reciprocal motion while strengthening the forearm itself. The forearm is typically constructed of wood and/or plastic and generally fits below the magazine tube with upstanding segments straddling the magazine tube and sometimes a portion of the barrel.

The normal operation of a pump shotgun involves drawing the forearm back toward the receiver to withdraw a shell from the magazine, simultaneously ejecting a spent shell from the receiver if the gun has previously been fired. As the forearm is moved forward away from the receiver, the shell withdrawn from the magazine is loaded into the chamber in battery position for firing. A difficulty common to all existing pump shotguns is the tendency of the forearm to twist with respect to the magazine tube. That is, the forearm may rotate with respect to the magazine tube to a greater extent at one end than at its other end, thereby causing a distortion of the desired concentric orientation of the mount tube with respect to the magazine tube. As a consequence, the action of the forearm is impeded by binding of these two members. The resulting rough action is annoying and often interferes with accurate marksmanship.

SUMMARY OF THE INVENTION

According to this invention, the forearm is mounted to the magazine tube through a magazine mount tube or other coupling means so that the forearm is connected to the magazine tube in a free-sliding arrangement longitudinally with respect to the axis of the magazine tube, but in a non-twisting relationship with the magazine tube. The forearm mount tube or equivalent member is adapted interiorally with a coupling structure, and the exterior of the magazine tube carries cooperatively adapted coupling structure. The coupling structures interact to form the coupling means described.

In one form of the invention, a plurality of approximately parallel track members are mounted approximately parallel the axis of the magazine tube and external the magazine tube, while a corresponding plurality of surface members are carried in association with the forearm to register with the track members. In this fashion, rotational movement of the forearm with respect to the axis of the magazine tube is limited. The parallel track members may be raised bosses, but are more commonly grooves in the exterior sidewall of the magazine tube. In practice, it has been found that three such grooves approximately equally spaced about the perimeter of the magazine tube provide consistently satisfactory performance. The surface members carried by the forearm may comprise a series of rows of detents extending inward from the forearm or a forearm mount tube to register with the gooves carried in the exterior sidewall of the magazine tube. For best results, each row should include at least two detents spaced longitudinally from each other sufficiently to hold the interior wall of the forearm mount tube approximately parallel the exterior wall of the magazine tube.

BRIEF DESCRIPTION OF THE DRAWINGS

In the drawings, which illustrate what is presently regarded as the best mode for carrying out the invention.

DESCRIPTION OF THE ILLUSTRATED EMBODIMENT

Figure 1:
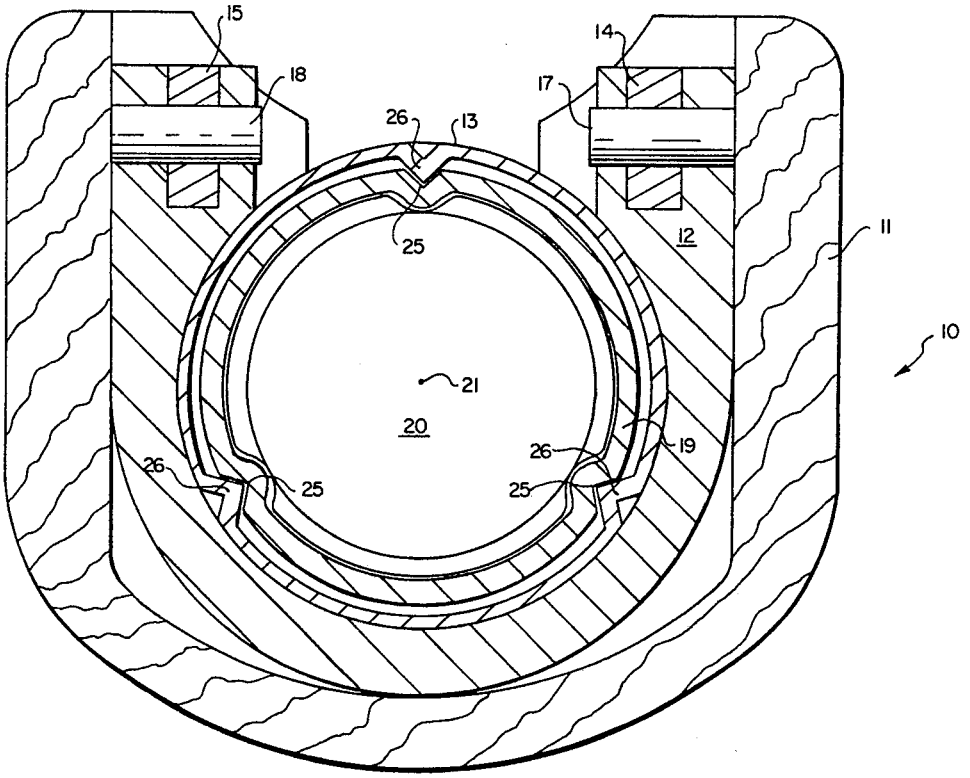
FIG. 1 is a sectional view of the forearm mounting system of this invention.
Figure 2:
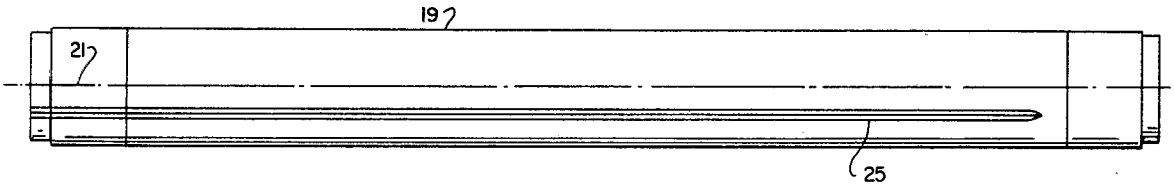
FIG. 2 is a view in elevation of the magazine tube shown in FIG. 1.

Referring specifically to FIG. 1, a forearm mounting system, designated generally 10, includes a forearm 11, illustrated as constructed of wood, straddling all of the other components of the system. These components include an action bar connector 12 welded to a forearm mount tube 13. Action bars 14, 15 are connected to the action bar connector with action bar pins 17, 18. The forearm mount tube 13 fits concentrically and exteriorally of magazine tube 19. A conventional magazine follower 20 is shown within the magazine tube 19. The central axis of the assembly including the magazine follower 20, the magazine tube 19 and the forearm mount tube 13 is designated by the point 21 in FIG. 1 and shown as the line 21 in FIGS. 2 and 3.

Figure 3:
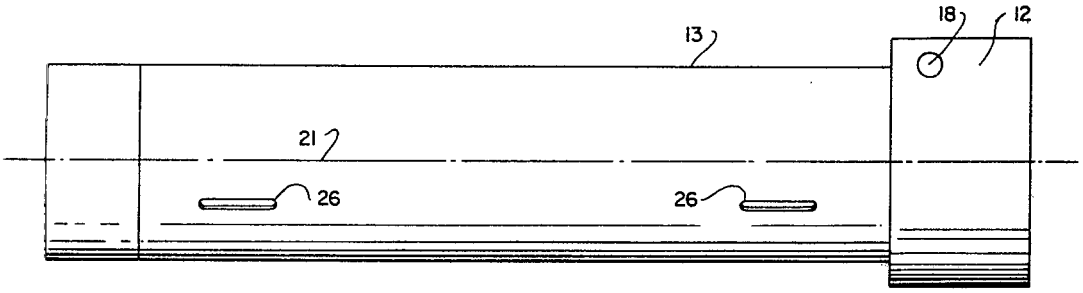
FIG. 3 is a view in elevation of the mounting tube member shown in FIG. 1.

Three grooves 25 are provided in the exterior sidewall of the magazine tube 19. Each groove extends approximately the entire length of the magazine tube 19, as may be best seen from FIG. 2. As illustrated, the grooves 26 are radially spaced from each other by approximately 120°, although other spacings may be preferred in certain instances. Three rows of detents 26 are provided along the interior sidewall of the forearm mount tube 13 in registration with the grooves 25. Referring to FIG. 3, at least two detents 26 are provided in registration with each groove 25 thereby providing against tilting of the forearm mount tube with respect to the central axis 21 of the magazine tube 19. The detents 26 appear as dimples in the exterior sidewall of the forearm mount tube in FIG. 3, because in the illustrated instance, they are formed by stamping techniques.

Reference herein to details of the illustrated embodiment is not intended to restrict the scope of the appended claims, which themselves recite those features regarded as essential to the invention.

I claim:

1. In a pump shotgun wherein shells stored in a magazine tube are removed from storage; loaded into a chamber, and thereafter are removed from said chamber and ejected from the receiver of said gun by the operation of mechanism actuated by reciprocal motion of a forearm mounted to slide axially with respect to said magazine tube, the improvement comprising:

a plurality of approximately parallel track members mounted approximately parallel the axis of said magazine tube and external said magazine tube; and a plurality of surface members carried in association with said forearm to register with said track members; thereby limiting rotational movement of said forearm with respect to the axis of said magazine tube.

2. An improvement according to claim 1 wherein said track members comprise grooves in the exterior sidewall of said magazine tube.

3. An improvement according to claim 2 wherein three said grooves are spaced around the exterior perimeter of said magazine tube.

4. An improvement according to claim 1 wherein said surface members are carried by a forearm mount tube disposed concentric with said magazine tube in slideable association therewith.

5. An improvement according to claim 4 wherein said track members comprise grooves in the exterior sidewall of said magazine tube and said surface members comprise detents extending inward from said forearm mount tube.

6. An improvement according to claim 5 including a plurality of rows of said detents, said plurality of rows corresponding in number of said plurality of grooves, each said row of detents being in registration with a respective said groove.

7. An improvement according to claim 6 including three said grooves spaced approximately evenly around the perimeter of said magazine tube.

8. An improvement according to claim 7 wherein each said row includes at least two detents spaced longitudinally from each other sufficiently to hold the interior wall of said forearm mount tube approximately parallel the exterior wall of said magazine tube.

9. A cartridge storage and retrieval assembly for pump shotguns comprising:

a magazine tube;

a forearm mounted to reciprocate along said tube, thereby actuating mechanism which moves a shell from a chamber and replaces said removed shell with another shell retrieved from said magazine; and coupling means connecting said forearm with said magazine tube in free sliding arrangement longitudinally with respect to the axis of said magazine tube, said coupling means being adapted substantially to prevent said forearm from rotating with respect to said magazine tube to a greater extent at one end than at its other end.

10. An assembly according to claim 9 wherein said forearm carries a forearm mount tube; and the interior of said mount tube and the exterior of said magazine tube carry respective structures which cooperatively constitute said coupling means.

* * * * *